US010014134B2

(12) United States Patent
Dahl et al.

(10) Patent No.: US 10,014,134 B2
(45) Date of Patent: Jul. 3, 2018

(54) ROTOR SHAFT MODULE FOR A ROTOR SHAFT OF A MOLDED-CASE CIRCUIT BREAKER, ROTOR SHAFT FOR A MOLDED-CASE CIRCUIT BREAKER, MOLDED-CASE CIRCUIT BREAKER COMPRISING A ROTATOR SHAFT, AND METHOD FOR PRODUCING A ROTOR SHAFT MODULE FOR A ROTOR SHAFT OF A MOLDED-CASE CIRCUIT BREAKER

(71) Applicant: Siemens Aktiengesellschaft, Munich (DE)

(72) Inventors: Jörg-Uwe Dahl, Werder (DE); Erhard Deylitz, Berlin (DE); Wolfgang Erven, Amberg (DE); Björn Gehrke, Berlin (DE); Alexander Kupsch, Berlin (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 137 days.

(21) Appl. No.: 14/583,845

(22) Filed: Dec. 29, 2014

(65) Prior Publication Data

US 2015/0262772 A1 Sep. 17, 2015

(30) Foreign Application Priority Data

Mar. 14, 2014 (DE) ..... 10 2014 204 750

(51) Int. Cl.
*H01H 23/00* (2006.01)
*H01H 19/10* (2006.01)
(Continued)

(52) U.S. Cl.
CPC ..... *H01H 19/10* (2013.01); *H01H 1/2058* (2013.01); *H01H 9/00* (2013.01);
(Continued)

(58) Field of Classification Search
CPC ..... H01H 19/10; H01H 11/00; H01H 9/00; H01H 1/2058; H01H 71/0257;
(Continued)

(56) References Cited

U.S. PATENT DOCUMENTS 6,259,338 B1 6/2001 Boeder et al.
6,717,089 B1 * 4/2004 Azzola ..... H01H 1/5822 218/146
(Continued)

FOREIGN PATENT DOCUMENTS

CN 101399137 A 4/2009
DE 19910032 C1 4/2000
(Continued)

OTHER PUBLICATIONS

Extended European Search Report dated Aug. 3, 2015.
(Continued)

*Primary Examiner* — Edwin A. Leon
*Assistant Examiner* — Lheiren Mae A Caroc
(74) *Attorney, Agent, or Firm* — Harness, Dickey & Pierce, PLC

(57) ABSTRACT

A rotor shaft module for a rotor shaft of a molded-case circuit breaker, includes a module body including an electrically insulating first material, the module body including a receptacle for a contact element of the molded-case circuit breaker. The rotor shaft module includes at least one coupling apparatus for connection to an opposing coupling apparatus of a further rotor shaft module. In addition, disclosed are a rotor shaft for a molded-case circuit breaker includes at least two coupled rotor shaft modules; a molded-case circuit breaker including a rotor shaft; and a method for producing a rotor shaft module for a rotor shaft of a molded-case circuit breaker.

16 Claims, 3 Drawing Sheets

(51) Int. Cl.

| | |
|---|---|
| ***H01H 9/00*** | (2006.01) |
| ***H01H 11/00*** | (2006.01) |
| *H01H 1/20* | (2006.01) |
| *H01H 71/02* | (2006.01) |

(52) U.S. Cl.
CPC ..... *H01H 11/00* (2013.01); *H01H 1/2041* (2013.01); *H01H 71/0235* (2013.01); *H01H 71/0257* (2013.01); *H01H 2009/0094* (2013.01); *H01H 2205/002* (2013.01); *H01H 2221/056* (2013.01); *Y10T 29/49105* (2015.01)

(58) Field of Classification Search
CPC ..... H01H 2009/0094; H01H 1/2041; H01H 2221/056; H01H 2205/002; H01H 71/0235; Y10T 29/49105
USPC ..... 200/244, 401, 336, 563–573; 335/6, 335/8–10
See application file for complete search history.

(56) References Cited

U.S. PATENT DOCUMENTS

| | | | | |
|---|---|---|---|---|
| 6,965,292 | B2 | 11/2005 | Ciarcia et al. | |
| 2012/0199452 | A1* | 8/2012 | Dahl ..... | H01H 1/2058 200/11 R |
| 2013/0206558 | A1 | 8/2013 | Bunk et al. | |

FOREIGN PATENT DOCUMENTS

| | | | |
|---|---|---|---|
| DE | 102012201939 | A1 | 8/2013 |
| EP | 0903764 | A2 | 3/1999 |
| EP | 1215695 | A2 | 6/2002 |

OTHER PUBLICATIONS

German Office Action dated Apr. 15, 2016.
Office Action for corresponding Chinese Application No. 201510113431.3 dated Nov. 30, 2017.

* cited by examiner

ROTOR SHAFT MODULE FOR A ROTOR SHAFT OF A MOLDED-CASE CIRCUIT BREAKER, ROTOR SHAFT FOR A MOLDED-CASE CIRCUIT BREAKER, MOLDED-CASE CIRCUIT BREAKER COMPRISING A ROTATOR SHAFT, AND METHOD FOR PRODUCING A ROTOR SHAFT MODULE FOR A ROTOR SHAFT OF A MOLDED-CASE CIRCUIT BREAKER

PRIORITY STATEMENT

The present application hereby claims priority under 35 U.S.C. § 119 to German patent application number DE 102014204750.1 filed Mar. 14, 2014, the entire contents of which are hereby incorporated herein by reference.

FIELD

At least one embodiment of the present invention generally relates to a rotor shaft module for a rotor shaft of a molded-case circuit breaker, having a module body including an electrically insulating first material, wherein the module body has a receptacle for a contact element of the molded-case circuit breaker, and the rotor shaft module has at least one coupling apparatus for connection to an opposing coupling apparatus of a further rotor shaft module. In addition, at least one embodiment of the invention generally relates to a rotor shaft for a molded-case circuit breaker, to a molded-case circuit breaker comprising a rotor shaft, and/or to a method for producing a rotor shaft module for a rotor shaft of a molded-case circuit breaker.

BACKGROUND

In modern technology, molded-case circuit breakers (MCCBs) are known and are used extensively. Such molded-case circuit breakers make it possible in particular to switch high currents or powers. Since such molded-case circuit breakers are often also formed with fuse apparatuses, such as, for example, an overload fuse and/or a short-circuit fuse, known molded-case circuit breakers also increase safety when switching such currents. In order to provide a current with a high power and/or a high intensity, the current is usually provided in polyphase form with in each case one line per phase.

In the event of the occurrence of a fault, for example an overload or a short circuit, in only one of these phases, however, all phases which are switched by a common molded-case circuit breaker need to be disconnected, however. Such molded-case circuit breakers therefore have a rotor shaft, wherein the rotor shaft is constructed from individual rotor shaft modules. A rotor shaft module is provided for each phase of the current to be conducted, wherein the rotor shaft module has a contact element, which is designed to open and close a conductive connection for the respective phase. The entire switching mechanism of the molded-case circuit breaker, in particular the rotor shaft consisting of rotor shaft modules with the respective contact elements for the individual phases, fixed contacts for each individual phase and the associated mechanism of the molded-case circuit breaker, forms a breaker latching mechanism of the molded-case circuit breaker.

In the case of molded-case circuit breakers, high torques act on the contact system which is formed by the fixed contacts and the contact element for each individual phase owing to the breaker latching mechanism and the current forces occurring. Each contact system of a phase of the molded-case circuit breaker needs to be coupled in electrically insulating fashion to one another. Therefore, it is known from the prior art to produce the individual rotor modules from an electrically insulating material, for example plastics.

However, not all materials are capable of absorbing the forces or torques occurring during tripping of the molded-case circuit breaker and also even the permanent loading by the static forces occurring during operation of the molded-case circuit breaker. It is also possible for thermal loading to occur in the case of high currents or electric powers, which thermal loading impairs the strength of the materials used.

In particular in the case of plastics materials which are electrically insulating and are therefore used as material for the rotor modules, the strength and/or rigidity of the rotor modules can be reduced by an input of heat into the plastics material. Owing to the resultant pressure losses, the contact forces can be reduced and therefore the functional reliability of the molded-case circuit breaker can be endangered.

In accordance with the prior art, it is known to solve these problems in particular by virtue of the provision of lower tolerances of the contours of coupling apparatuses used to connect the individual rotor modules. By virtue of these low production tolerances, in particular in order to avoid pre-existing defects in the connecting apparatus owing to these low tolerances, however, complex measures are required in the manufacture and fitting of the rotor shaft modules of the molded-case circuit breaker.

In order to transfer the rotational forces occurring, such low tolerances are sometimes already necessary in the manufacture of the rotor shaft modules that destruction of a coupling apparatus may arise in the case of only slightly faulty or else only unnoticeable fitting of the rotor shaft modules to a rotor shaft. Furthermore, owing to the use of plastics, the maximum transferable rotational force between the individual rotor shaft modules is limited.

However, this also limits the intensity of the current or the level of the power which can be switched by the molded-case circuit breaker. This is because high currents or high powers also entail high current forces, wherein the resultant higher torques can no longer be safely transferred by the connecting apparatuses between the individual rotor modules of the rotor shaft of the molded-case circuit breaker in the case of tripping of the molded-case circuit breaker, in the worst case scenario. Failure of the molded-case circuit breaker at high currents or high electrical powers can thus not safely be ruled out.

SUMMARY

At least one embodiment of the invention is directed to reducing or even eliminating at least one of the above-described disadvantages of rotor shaft modules, rotor shafts or molded-case circuit breakers at least partially. In particular, embodiments of the invention are directed to a rotor shaft module, a rotor shaft, a molded-case circuit breaker and a method for producing a rotor shaft module in which, in a particularly simple and inexpensive manner, particularly good transfer of rotational forces between adjacent rotor shaft modules can be ensured.

A rotor shaft module for a rotor shaft of a molded-case circuit breaker, a rotor shaft for a molded-case circuit breaker, a molded-case circuit breaker having a rotor shaft, and a method for producing a rotor shaft module for a rotor shaft of a molded-case circuit breaker are disclosed. In this case, features and details which are described in connection with the rotor shaft module according to embodiments of the invention do of course also apply in connection with the rotor shaft according to embodiments of the invention, the molded-case circuit breaker according to embodiments of the invention and the method according to embodiments of the invention, and vice versa in each case, with the result that reciprocal reference is or can always be made to the individual aspects of embodiments of the invention with respect to the disclosure.

In a first aspect of an embodiment of the invention, a rotor shaft module for a rotor shaft of a molded-case circuit breaker, is disclosed including a module body including an electrically insulating first material, wherein the module body has a receptacle for a contact element of the molded-case circuit breaker, and the rotor shaft module has at least one coupling apparatus for connection to an opposing coupling apparatus of a further rotor shaft module. A rotor shaft module according to an embodiment of the invention includes a rotor shaft module that has an insert element which is fixed on the module body, wherein the insert element comprises a second material, which has a higher strength than the first material, wherein the insert element is completely spaced apart from the receptacle by the electrically insulating first material of the module body, and wherein the at least one coupling apparatus is formed by the insert element.

In accordance with a second aspect of an embodiment of the invention, a rotor shaft for a molded-case circuit breaker is disclosed, having at least two coupled rotor shaft modules. A rotor shaft according to an embodiment of the invention is characterized by the fact that the at least two rotor shaft modules are designed in each case in accordance with the first aspect of embodiments of the invention. All of the advantages which have been described in respect of a rotor shaft module in accordance with the first aspect of embodiments of the invention therefore do of course also result for a rotor shaft according to the invention which has such rotor shaft modules in accordance with the first aspect of the invention.

In a third aspect of an embodiment of the invention, a molded-case circuit breaker comprising a rotor shaft is disclosed. A molded-case circuit breaker according to an embodiment of the invention is in this case characterized by the fact that the rotor shaft is designed in accordance with the second aspect of an embodiment of the invention.

Furthermore, in accordance with a fourth aspect of an embodiment of the invention, a method for producing a rotor shaft module is disclosed, in accordance with the first aspect of an embodiment of the invention for a rotor shaft of a molded-case circuit breaker. A method according to an embodiment of the invention is characterized by the fact that the electrically insulating first material of the module body is formed around the insert element in a forming process.

BRIEF DESCRIPTION OF THE DRAWINGS

A rotor shaft module according to embodiments of the invention, a rotor shaft according to embodiments of the invention and a molded-case circuit breaker according to embodiments of the invention as well as the developments and advantages thereof will be explained in more detail below with reference to drawings, in which, schematically.

Elements with the same function and mode of operation are each provided with the same reference symbols.

DETAILED DESCRIPTION OF THE EXAMPLE EMBODIMENTS

Figure 1:
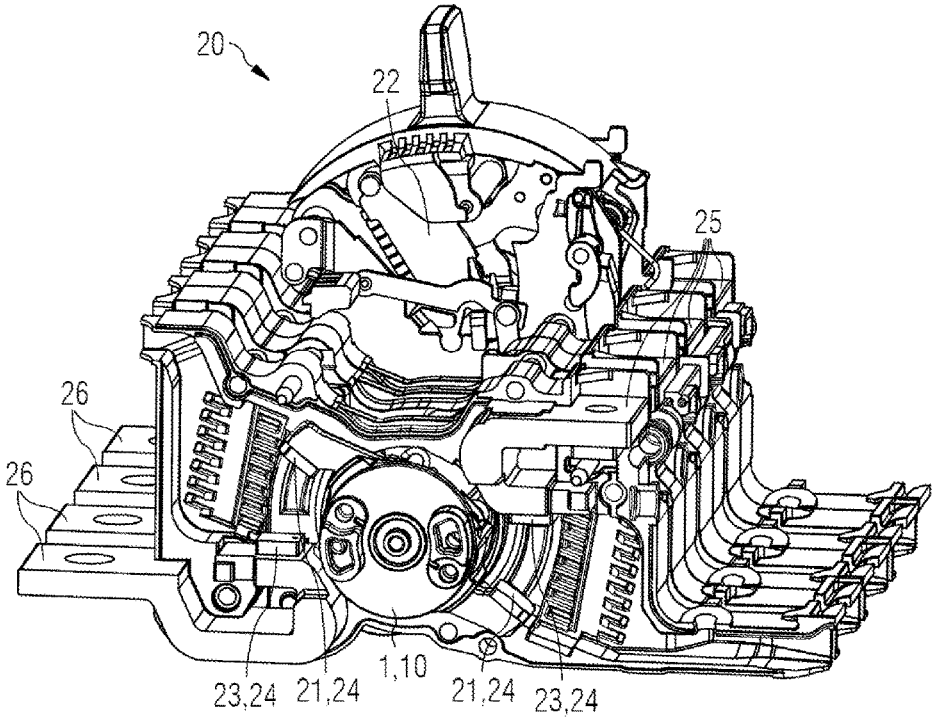
FIG. 1 shows a molded-case circuit breaker according to an embodiment of the invention.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

In a first aspect of an embodiment of the invention, a rotor shaft module for a rotor shaft of a molded-case circuit breaker, is disclosed including a module body including an electrically insulating first material, wherein the module body has a receptacle for a contact element of the molded-case circuit breaker, and the rotor shaft module has at least one coupling apparatus for connection to an opposing coupling apparatus of a further rotor shaft module. A rotor shaft module according to an embodiment of the invention includes a rotor shaft module that has an insert element which is fixed on the module body, wherein the insert element comprises a second material, which has a higher strength than the first material, wherein the insert element is completely spaced apart from the receptacle by the electrically insulating first material of the module body, and wherein the at least one coupling apparatus is formed by the insert element.

A rotor shaft module in accordance with an embodiment of the present invention is intended for use in a rotor shaft of a molded-case circuit breaker. A receptacle in which a contact element of the molded-case circuit breaker can be arranged is located in a module body of the rotor shaft module, wherein the contact element in the molded-case circuit breaker can be designed to form moving contacts of a contact system of the molded-case circuit breaker for one phase of the current to be conducted together with the fixed contacts. The rotor shaft module in this case has at least one coupling apparatus, which is designed for connection to a mating coupling apparatus of a further rotor shaft module, as a result of which a plurality of rotor shaft modules can be combined to form a rotor shaft of the molded-case circuit breaker.

Provision is made in accordance with an embodiment of the invention for the rotor shaft module to have, in addition to the module body, an insert element, which is fixed on the module body. In this case, the insert element comprises a second material, which differs in particular from the first electrically insulating material of the module body. In this case, it is of course possible for the insert element to consist completely of the second material. A substantial difference between the first and second materials consists in this case in that the second material has a higher strength. Such a higher strength can be manifested in particular in a higher degree of rigidity, in particular in respect of rotational loading. The second material can also be designed in such a way that this greater strength even remains in the case of a high input of heat, such as may occur, for example, during operation of a molded-case circuit breaker at high currents and/or electric powers.

In addition, provision is made according to an embodiment of the invention for the coupling apparatus of the rotor shaft module to be formed by the insert element. As a result, it is possible, in conjunction with the fixing of the insert element to the module body, in particular owing to the increased rigidity of the second material of the insert element, to transfer greater rotational forces between the individual rotor modules in the rotor shaft of the molded-case circuit breaker. This firstly results in the advantage that the molded-case circuit breaker can be provided for higher currents since, owing to the capability of transferring higher rotational forces, higher current switching forces can also be overcome, as a result of which safe tripping of the molded-case circuit breaker can be ensured even at these higher currents. Furthermore, it is also possible to reduce the requirements in respect of the precise fit or the tolerances during manufacture of the coupling apparatus without needing to run the risk of losses in safety with respect to the functionality of the molded-case circuit breaker in which the rotor shaft module is installed.

A smaller number of rejects during manufacture and fitting of the rotor shaft modules according to the invention can thus be achieved. Furthermore, by virtue of the second material, which does not reduce its strength, or only reduces its strength to an insignificant extent, in particular with an input of heat, safe switching of high currents which have a high level of waste heat can be ensured.

By virtue of the fact that the insert element is completely spaced apart from the receptacle in which the contact element of the molded-case circuit breaker can be arranged by the first electrically insulating material of the module body, it is possible furthermore to ensure that there is no contact between the insert element and the contact element in the assembled state. As a result, restrictions in respect of the selection of the second material can be prevented to the extent that, for example, even electrically conductive materials can be used for the second material. In particular, the use of metals and/or metal alloys as second material for the insert element is thus made possible.

Preferably, in this case the module body and the insert element can be designed in such a way that leakage currents on the surface of the material of the module body can also be avoided. In particular, it is thus also possible for the insert element to consist completely of a second material, wherein this material can also be electrically conductive. Provision can also be made for the at least one coupling apparatus of the rotor shaft module, which is formed by the insert element, to have insertion or fitting aids such as bevels and/or chamfers, for example. Furthermore, provision can also be made for the rotor shaft module to be provided for a single-phase molded-case circuit breaker, in which case the coupling apparatus of the rotor shaft module is formed for coupling to an opposing coupling apparatus of an external mount of the rotor shaft formed by the single rotor shaft module.

Furthermore, in a rotor shaft module according to an embodiment of the invention, provision can be made for the insert element to be arranged at least partially in the interior of the module body. This makes it possible to ensure that particularly good force transfer can take place between the insert element and the module body. By virtue of the fact that the contact element is arranged in the receptacle in the module body, particularly good force transfer from the insert element to the contact element is thus also made possible. Particularly high switching forces can be produced thereby, as a result of which the operation of a molded-case circuit breaker with such a rotor shaft module can be made more reliable.

Particularly preferably, in the case of a rotor shaft module according to an embodiment of the invention, provision can be made for the rotor shaft module to have at least one opposing coupling apparatus, wherein the at least one opposing coupling apparatus is formed by the insert element. The insert element can be formed in particular in one piece, in one part and/or monolithically. Particularly effective force transfer or passing on of forces can be produced thereby.

Particularly preferably, provision can be made in this case for the opposing coupling apparatus of the rotor shaft module to be configured such that it can be coupled to a coupling apparatus of a further rotor shaft module so as to form a rotor shaft. It is thus possible to ensure that the force transfer in the rotor shaft of the molded-case circuit breaker can be performed by the insert elements of the individual rotor shaft modules. By virtue of the second material of the insert elements, which has greater strength than the first material of the module bodies, improved force transfer within the entire rotor shaft of the molded-case circuit breaker can thus be ensured. It is of course also possible for the at least one opposing coupling apparatus to have insertion or fitting aids, such as bevels and/or chamfers, for example. The assembly of the individual rotor shaft modules to form a rotor shaft can be facilitated thereby.

In a preferred development of a rotor shaft module according to an embodiment of the invention, provision can additionally be made for the at least one coupling apparatus and the at least one opposing coupling apparatus to be arranged at different axial ends of the rotor shaft module. Both the coupling apparatus and the opposing coupling apparatus are formed by the insert element. By virtue of an arrangement of the coupling apparatus and the opposing coupling apparatus at different axial ends of the rotor shaft module, it is possible to produce a rotor shaft from a plurality of such rotor shaft modules, which in particular have an identical design. The provision of different rotor shaft modules to construct a rotor shaft can thus be avoided. The individual rotor shaft modules can thus be produced in large numbers, as a result of which, firstly, manufacture is facilitated and, secondly, the manufacturing costs for the manufacture of rotor shaft modules can be reduced.

A rotor shaft module can also be designed such that the insert element is arranged in the form of a frame around the receptacle. In this case, provision can of course be made for the insert element to be completely enveloped by the module body in the region of the receptacle. Owing to the frame-shaped form, in particular when the contact element is installed in the receptacle of the module body, the contact element is pushed through an opening, which is formed by the frame-shaped insert element. Particularly effective force transfer between the insert element, which, via the at least one coupling apparatus, determines the force transfer in the rotor shaft, to the contact element can thus be ensured. Owing to the frame-shaped configuration of the insert element, the insert element is designed to surround the contact element in the receptacle of the module body. Rotational movements of the rotor shaft and therefore of the insert element can thus be transferred to the contact element particularly easily. Particularly high currents are therefore switchable in a molded-case circuit breaker with such a rotor shaft module.

Provision can also be made in the case of a rotor shaft module according to the invention for the insert element to have two or more coupling apparatuses and two or more opposing coupling apparatuses. By virtue of the provision of a plurality of coupling apparatuses and opposing coupling apparatuses, the force transfer between two rotor shaft modules, which are connected via these coupling apparatuses and opposing coupling apparatuses, can be further improved.

A force distribution between the individual coupling apparatuses or opposing coupling apparatuses can also reduce the forces which act on an individual coupling apparatus or opposing coupling apparatus. Therefore, less force needs to be transferred per coupling apparatus or opposing coupling apparatus. As a result, firstly the specific requirements placed on the individual coupling apparatus or opposing coupling apparatus can be reduced and, secondly, overall an increased level of force can be transferred via the entirety of the coupling apparatuses or opposing coupling apparatuses.

In this case, the two or more coupling apparatuses and the two or more opposing coupling apparatuses can be arranged on the insert element in a variety of ways. Thus, for example, all of the existing coupling apparatuses or opposing coupling apparatuses can be provided on the insert element in such a way that they are arranged at the same axial end of the rotor shaft module. A particularly effective and secure connection to a further rotor shaft module can thus be ensured.

A further possibility resides in the coupling apparatuses and the opposing coupling apparatuses being provided in the insert element in such a way that the coupling apparatuses are arranged at one axial end of the rotor shaft module and the opposing coupling apparatuses are arranged at the other axial end of the rotor shaft module. As a result, in turn a modular design of the rotor shaft comprising structurally identical rotor shaft modules is possible, wherein in each case the coupling apparatuses of one rotor shaft module are connected to the opposing coupling apparatuses of a second rotor shaft module. Even by this means it is possible to ensure particularly effective force transfer between the rotor shaft module since at least two pairs of coupling apparatuses and opposing coupling apparatuses are provided.

A rotor shaft module according to an embodiment of the invention can furthermore be designed such that the rotor shaft module has at least one connecting apparatus for connection to an opposing connecting apparatus of a further rotor shaft module, wherein the at least one connecting apparatus is formed by the module body. By virtue of the connection apparatus, it is possible to produce an even more reliable connection between different rotor shaft modules of a rotor shaft constructed from rotor shaft modules. In this case, a rotor shaft module can of course also have a plurality of such connection apparatuses and furthermore also one or more such opposing connection apparatuses, with the result that all of the variants described in respect of the coupling apparatuses and the advantages which can be achieved thereby can also be achieved by connection apparatuses and opposing connection apparatuses.

In this case, the connection apparatuses or the opposing connection apparatuses can be used in particular for precise positioning of the individual rotor shaft modules with respect to one another since the force transfer between the rotor shaft modules is substantially generated by the coupling apparatuses and opposing coupling apparatuses, which are formed by the insert element, in accordance with the invention. The low manufacturing tolerances of the connection apparatuses, as are known in accordance with the prior art, can be avoided thereby, as a result of which the production of the rotor shaft modules can be facilitated.

Particularly preferably, in the case of a rotor shaft module according to an embodiment of the invention, provision can be made for the electrically insulating material of the module body to be a plastics material and/or for the insert element to consist of metal and/or a fiber composite material. Plastics materials are electrically insulating materials which can be processed easily, simply and in a versatile manner. In particular, such plastics materials can also be used in an injection-molding process, as a result of which a wide range of possible form variants for rotor shaft modules is possible.

A feature, according to an embodiment of the invention, of the second material of the insert element resides in that it has a greater strength than the first material of the module body. Metals and/or fiber composite materials are such materials. In this case, a metal alloy can of course also be used as metal for the insert element. Metals and/or fiber composite materials are materials with a high strength, in particular also with respect to rotational loading.

Owing to the property of a rotor shaft module according to the invention that the insert element consists of metal and/or a fiber composite material, it is therefore possible to ensure that higher rotational forces can be transferred by a rotor shaft module according to the invention than by rotor shaft modules in accordance with the prior art. Firstly, the switching reliability of a molded-case circuit breaker in which such a rotor shaft module is used can thus be increased, wherein secondly a possible current intensity or a level of the switchable power of the molded-case circuit breaker can be increased at the same time.

Particularly preferably, in a rotor shaft module according to an embodiment of the invention, provision can furthermore be made for the rotor shaft module to be produced in a molding method, in particular an injection molding method, wherein the electrically insulating material of the module body is formed, in particular by injection molding, around the insert element. By virtue of forming the electrically insulating first material of the module body around the insert element, particularly effective fixing of the insert element to and in particular in the module body is made possible. Particularly preferably, in this case the first material is a plastics material and the molding process is a plastic molding process.

Particularly preferably, the molding process is furthermore an injection-molding process. In this case, in particular an arrangement of the insert element in an injection mold which is filled with the electrically insulating material of the module body during the injection-molding process thereafter is in particular provided. It is of course also conceivable for a two-component injection-molding process to be used in which, as the first step, the insert element, for example consisting of a fiber composite material, is produced in an injection mold and then the electrically insulating first material of the module body is injection-molded around this insert element in the second step. Particularly secure fixing of the insert element in the module body can thus be produced. Furthermore, by virtue of the use of an injection-molding process, high production numbers of the module bodies can be produced in a particularly simple and inexpensive manner.

In accordance with a second aspect of an embodiment of the invention, a rotor shaft for a molded-case circuit breaker is disclosed, having at least two coupled rotor shaft modules. A rotor shaft according to an embodiment of the invention is characterized by the fact that the at least two rotor shaft modules are designed in each case in accordance with the first aspect of embodiments of the invention. All of the advantages which have been described in respect of a rotor shaft module in accordance with the first aspect of embodiments of the invention therefore do of course also result for a rotor shaft according to the invention which has such rotor shaft modules in accordance with the first aspect of the invention.

In a third aspect of an embodiment of the invention, a molded-case circuit breaker comprising a rotor shaft is disclosed. A molded-case circuit breaker according to an embodiment of the invention is in this case characterized by the fact that the rotor shaft is designed in accordance with the second aspect of an embodiment of the invention.

Such a rotor shaft in accordance with the second aspect of an embodiment of the invention has rotor shaft modules in accordance with the first aspect of embodiments of the invention. All of the advantages which have been described in relation to a rotor shaft in accordance with the second aspect of an embodiment of the invention or in relation to a rotor shaft module in accordance with the first aspect of an embodiment of the invention therefore do of course also result for a molded-case circuit breaker according to an embodiment of the invention which has such a rotor shaft in accordance with the second aspect of an embodiment of the invention having rotor shaft modules in accordance with the first aspect of an embodiment of the invention.

Furthermore, in accordance with a fourth aspect of an embodiment of the invention, a method for producing a rotor shaft module is disclosed, in accordance with the first aspect of an embodiment of the invention for a rotor shaft of a molded-case circuit breaker. A method according to an embodiment of the invention is characterized by the fact that the electrically insulating first material of the module body is formed around the insert element in a forming process.

Particularly preferably, in this case the first material is a plastics material and the molding process is a plastics molding process. By molding the electrically insulating first material of the module body around the insert element, the insert element can be fixed particularly easily to and in particular in the module body. The fixing is in this case provided directly by the electrically insulating first material of the module body, with the result that additional fixing elements are not required. The fixing of the insert element on or in the module body is thus facilitated whilst at the same time increasing the reliability of the fixing produced. Furthermore, in this case all of the advantages which have been described in relation to a rotor shaft module in accordance with the first aspect of an embodiment of the invention can of course be achieved with a method for producing a rotor shaft module in accordance with the first aspect of an embodiment of the invention.

Particularly preferably, in a development of a method according to an embodiment of the invention, provision can be made for the molding process to be an injection-molding process and for the electrically insulating first material of the module body to be injection-molded around the insert element. An injection-molding process is in this case a particularly versatile molding process and furthermore is a particularly simple manner in which to produce a rotor shaft module according to an embodiment of the invention in accordance with the first aspect of the invention. The insert element is in this case inserted into an injection mold and the electrically insulating first material of the module body is injection-molded around said insert element.

Particularly secure fixing of the insert element in the module body can thus be achieved. Furthermore, by using an injection-molding process, high numbers of module bodies can be produced in a particularly simple and inexpensive manner. A two-component injection-molding process in which, as a first step, the insert element, for example consisting of a fiber composite material, is produced in an injection mold and then the electrically insulating first material of the module body is injection-molded around this insert element in the second step, is of course also possible.

FIG. 1 shows a molded-case circuit breaker 20 according to an embodiment of the invention. In this case, the molded-case circuit breaker 20 has a breaker latching mechanism 22, which is designed in particular to actuate a contact system 24. In this case, the contact system 24 comprises fixed contacts 23 and a contact element 21 for each individual phase which can be switched by the molded-case circuit breaker 20, wherein one of these contact systems 24 is shown in FIG. 1. The contact element 21 is in this case arranged in a rotor shaft module 1 of a rotor shaft 10 of the molded-case circuit breaker 20.

By rotation of the rotor shaft 10, the contact element 21 and the fixed contacts 23 can be brought into touching contact with one another, as a result of which the contact system 24 is closed and current can flow. In this case, the molded-case circuit breaker 20 is designed to switch a plurality of phases, which can be seen from the plurality of first connections 25 and second connections 26. By actuation of the breaker latching mechanism 22, all of the contact systems 24 of the individual phases are closed in the case of a switch-on operation of the molded-case circuit breaker 20. If a fault state, for example an overload or a short circuit, occurs in the downstream circuit of one of the phases, all of the phases of the molded-case circuit breaker 20 need to be disconnected. The rotor shaft 10 which is constructed from a plurality of rotor shaft modules 1, is provided in the molded-case circuit breaker 20. Each of these rotor shaft modules 1 in this case has a receptacle 3 (not depicted), in which a contact element 21 is arranged for the respective phase. By virtue of a rotation of the rotor shaft 10 and therefore all of the rotor shaft modules 1, all of the contact systems 24 can thus be opened at the same time and the risk posed by the fault state in the downstream circuit can be eliminated.

Figure 2:
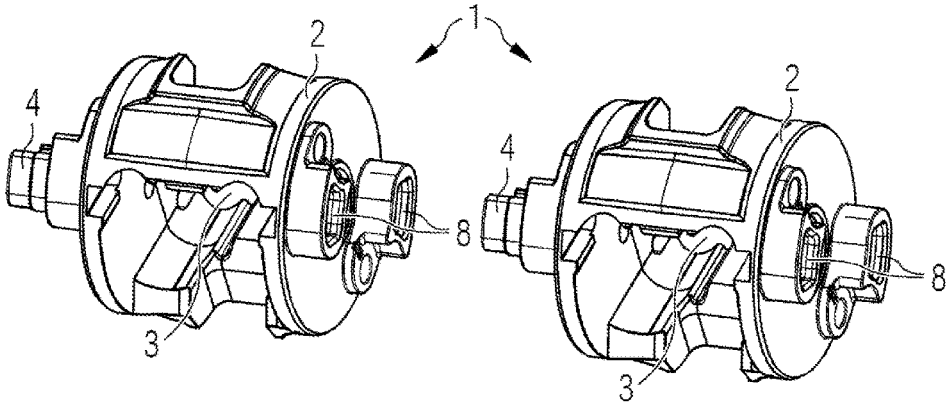
FIG 2 Prior art
FIG. 2 shows rotor shaft modules in accordance with the prior art, FIGS. 3*a, b, c* show various views of a rotor shaft module according to an embodiment of the invention, and FIGS. 4*a, b* show a rotor shaft according to an embodiment of the invention.

FIG. 2 shows two rotor shaft modules 1, which are designed in accordance with the prior art. The rotor shaft modules 1 in this case in particular have a module body 2, which is formed from an electrically insulating material. The rotor shaft modules 1 each have a receptacle 3 in the center, in which a contact element 21 of a molded-case circuit breaker 20 (not depicted) can be arranged. In particular, in this case this receptacle 3 is designed in such a way that a rotation of the rotor shaft module 1 also results in a rotation of the contact element 21, as a result of which opening and closing of the contact system 24 of the molded-case circuit breaker 20 can be performed.

In order to be able to connect the two rotor shaft modules 1 to form a rotor shaft 10 (not depicted), the module bodies 2 of the rotor shaft modules 1 are each formed with connection apparatuses 4 and opposing connection apparatuses 8. In this case, the connection apparatuses 4 and the opposing connection apparatuses 8 are designed in such a way that they can be plugged one inside the other and therefore produce a fixed connection between the rotor shaft modules 1. In the case of the rotor shaft modules 1 depicted, provision is made here for in each case either two connection apparatuses 4, with in each case only one of the two connection apparatuses 4 being shown, or two opposing connection apparatuses 8 to be provided at the same axial end of the rotor shaft module 1, which connection apparatuses and opposing connection apparatuses are opposite one another in each case with respect to an axis of the rotor shaft modules 1 and are arranged at the same radial spacing.

As a result, it is possible in a particularly simple manner to transfer rotational movements of one rotor shaft module 1 to the other rotor shaft module 1, as a result of which, in the assembled state, a rotor shaft 10 is formed by the rotor shaft modules 1. It has proven disadvantageous here that the connection apparatuses 4 and the opposing connection apparatuses 8 can only have very low tolerances, in particular in order to transfer high forces. This may result firstly in a high number of rejects during manufacture of the rotor shaft modules 1 in accordance with the prior art and secondly destruction of the rotor shaft modules 1, for example as a result of an opposing connection apparatus 8 bursting open, is also conceivable during installation, even as a result of only slightly improper fitting.

Figure 3A:
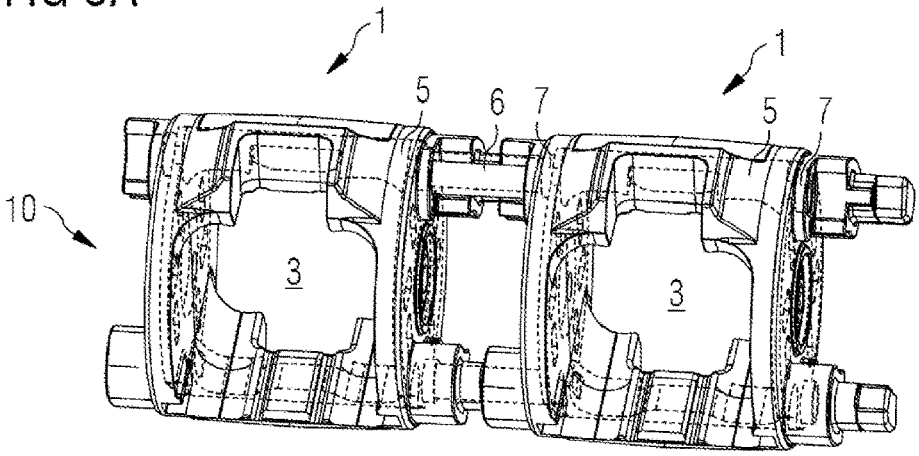
Figure 3B:
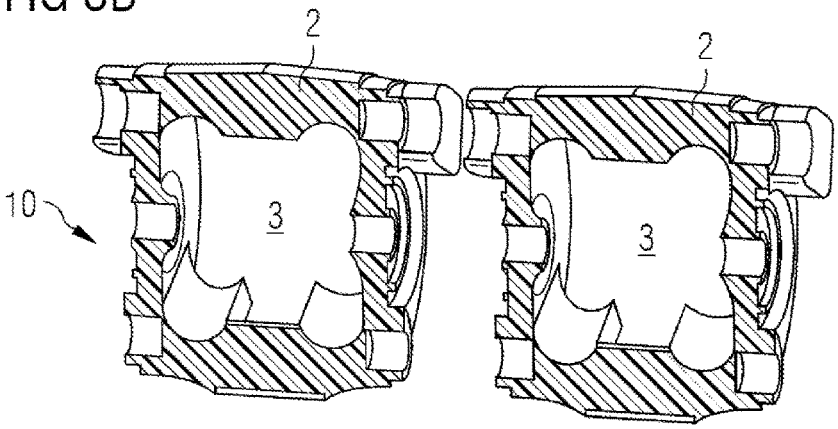
Figure 3C:
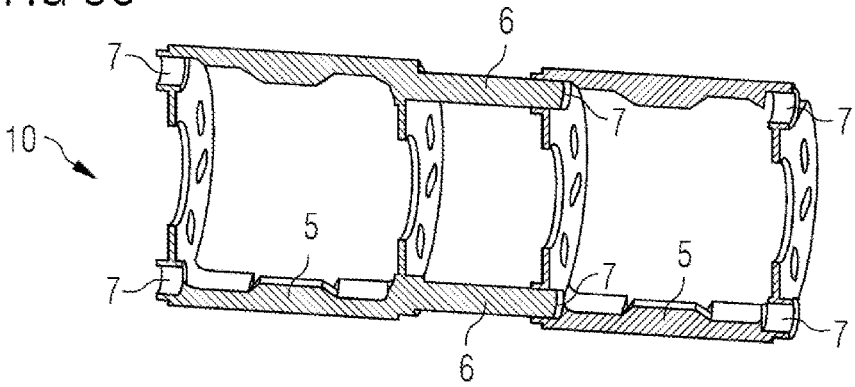

FIGS. 3*a*, 3*b* and 3*c* show various views of two rotor shaft modules 1 according to embodiments of the invention. In this case, FIG. 3*a* shows in each case the entire rotor shaft module 1, wherein the insert element 5 is shown in the interior of the respective rotor shaft module 1 visibly for illustrative purposes. FIG. 3*b* shows a sectional view of the module bodies 2 of the rotor shaft modules 1 according to embodiments of the invention, and FIG. 3*c* shows a sectional view of the insert elements 5 of the respective rotor shaft module 1.

The rotor shaft modules 1 according to embodiments of the invention in turn have a module body 2, which has in particular a receptacle 3 for a contact element 21 (not depicted) of a molded-case circuit breaker 20. It is essential to an embodiment of the invention that a rotor shaft module 1 according to an embodiment of the invention also has an insert element 5 and force transfer between the rotor shaft modules 1 in the assembled state to give the rotor shaft 10 is performed by coupling apparatuses 6 and opposing coupling apparatuses 7 of the insert elements 5. The module bodies 2 no longer need to perform this function and are now only arranged next to one another, as shown in FIG. 3*b*.

In addition, in the configuration shown, the insert elements 5 are designed in such a way that they extend in a form of a frame around the receptacle 3 in the module body 2. As a result, the contact element 21 can likewise be caused to rotate particularly effectively during a rotation of the rotor shaft 10 since the force transfer between the insert elements 5 and the respective contact element 21 is particularly effective owing to the frame-shaped configuration of the insert element 5.

Furthermore, FIG. 3*a* shows that the insert element 5 is completely spaced apart from the receptacle 3 by the material of the module body 2 in the region of the receptacle 3. In the configuration of a rotor shaft module according to the invention shown, the insert element 5 is even completely enveloped by the material of the module body 2 in the region of the receptacle 3. Since the material of the module body 2 is electrically insulating, an electrically conductive connection between the contact element 21 and the insert element 5 can thus be safely avoided.

It is thus possible to produce the insert element 5 from an electrically conductive material, for example metal or a metal alloy. A metal or a metal alloy has very good properties in respect of the transfer of forces, in particular rotational forces, as a result of which, overall, switching of the molded-case circuit breaker 20 in which such a rotor shaft 10 is installed can also be ensured at high currents or high switched electric powers by a rotor shaft 10 which is constructed from such rotor shaft modules 1 according to an embodiment of the invention.

FIGS. 3*b* and 3*c* each also show sectional views, firstly of the module bodies 2 in FIG. 3*b*, and secondly of the insert elements 5 in FIG. 3*c*. It can be seen in particular from FIG. 3*c* that, in the configuration of the rotor shaft modules 1 shown, a connection of the rotor shaft modules 1 is achieved in particular by the coupling apparatus 6 or the opposing coupling apparatuses 7 of the insert elements 5. Since the insert elements 5 include a material which has a greater strength than the material of the module bodies 2, improved and safer force transfer between the individual rotor shaft modules 1 and therefore within the rotor shaft 10 can thus be ensured.

Figure 4A:
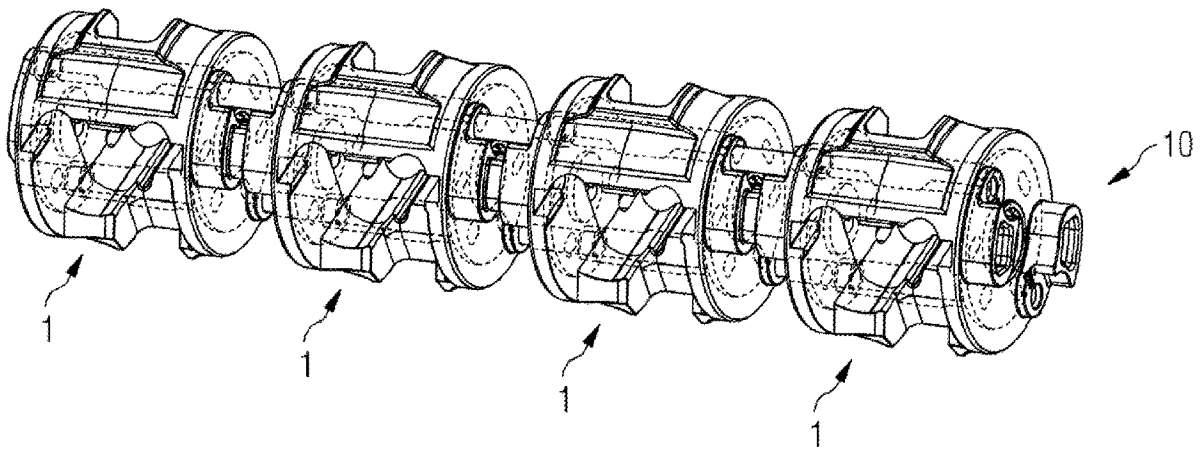
Figure 4B:
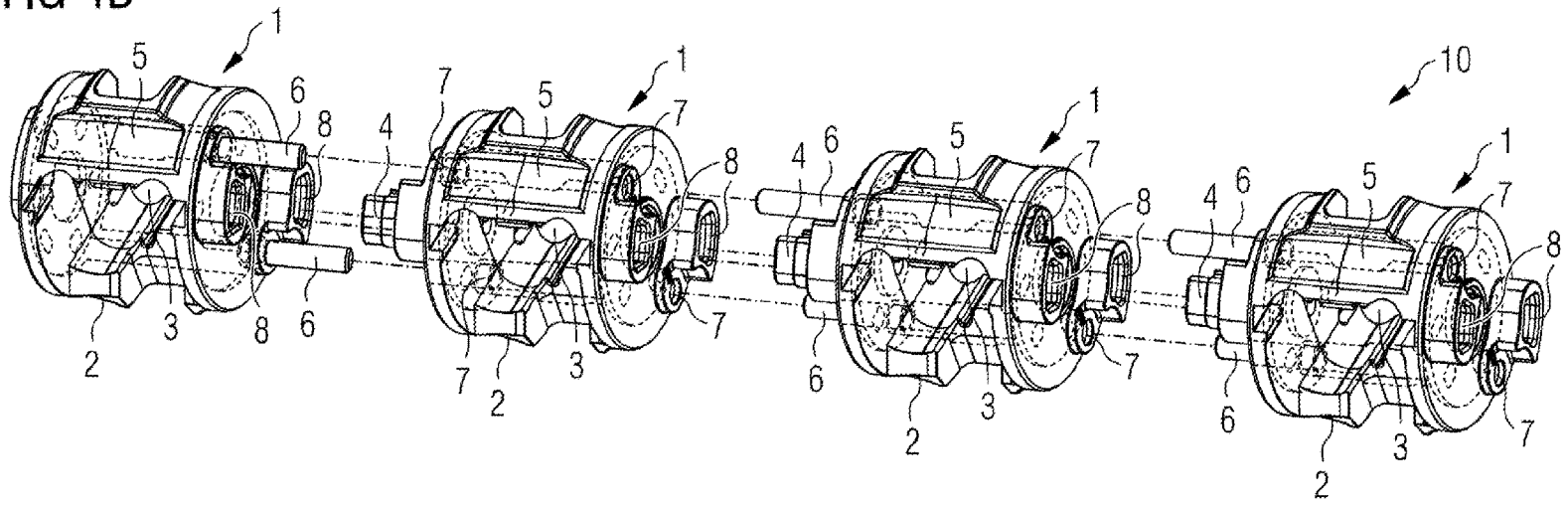

Such a rotor shaft 10 according to an embodiment of the invention is shown in FIGS. 4*a* and 4*b*. In this case, a completely fitted rotor shaft 10 comprising four rotor shaft modules 1 is shown in FIG. 4*a*. The same rotor shaft 10 is shown in FIG. 4*b* shortly before fitting using the four rotor shaft modules 1. The individual elements of the rotor shaft modules 1 are in this case only identified in FIG. 4*b*. In the configuration of the rotor shaft modules 1 according to an embodiment of the invention illustrated, these rotor shaft modules 1 also have connection apparatuses 4 or opposing connection apparatuses 8, which are formed by the module body 2, in addition to the coupling apparatuses 6 and the opposing coupling apparatuses 7 of the insert elements 5. These connection apparatuses 4 or the opposing connection apparatuses 8 serve in particular to stabilize or position the individual rotor shaft modules 1 with respect to one another, wherein substantially the coupling apparatuses 6 and the opposing coupling apparatuses 7 are provided for force transfer between the individual rotor shaft modules 1.

The insert elements 5 of the individual rotor shaft modules 1 are in this case again completely spaced apart from a receptacle 3 in the interior of the module body 2 by the material of the module body 2. As already described with reference to FIGS. 3*a*, 3*b* and 3*c*, an electrically conductive connection between the insert element 5 and a contact element 21 (not depicted) can thus be suppressed at any time. The insert element 5 can thus be manufactured from an electrically conductive material, for example a metal or a metal alloy. Other materials are of course also conceivable for the insert elements 5, wherein it is essential to an embodiment of the invention that the materials used for the insert elements 5 have a greater strength than the materials which are used for the module bodies 2. It can be seen clearly in particular from FIG. 4*a* that safe force transfer between the individual rotor shaft modules 1 can be ensured by the coupling apparatuses 6 and the opposing coupling apparatuses 7.

A rotor shaft 10, which is constructed from such rotor shaft modules 1 according to an embodiment of the invention, can therefore ensure that all of the contact elements 21 in the respective receptacles 3 of the respective rotor shaft modules 1 are actuable simultaneously or at least approximately simultaneously, as a result of which safety during switching, i.e. during tripping of the molded-case circuit breaker 20 (not depicted) in the event of a fault state in the downstream circuit, can be ensured at any time.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, and system. For example, of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

LIST OF REFERENCE SYMBOLS

1 Rotor shaft module
2 Module body
3 Receptacle
4 Connection apparatus
5 Insert element
6 Coupling apparatus
7 Opposing coupling apparatus
8 Opposing connection apparatus
10 Rotor shaft
20 Molded-case circuit breaker
21 Contact element
22 Breaker latching mechanism
23 Fixed contact
24 Contact system
25 First connection
26 Second connection

What is claimed is:

1. A rotor shaft module for a rotor shaft of a molded-case circuit breaker, comprising:

a module body including an electrically insulating first material, the module body including a receptacle for a contact element of the molded-case circuit breaker;

at least one coupling apparatus for connection to an opposing coupling apparatus of a further rotor shaft module; and an insert element, fixed on the module body, the insert element including a second material, including a relatively higher strength than the first material, and the insert element being completely spaced apart from the receptacle by the electrically insulating first material of the module body, the at least one coupling apparatus being formed by the insert element;

wherein the insert element traverses a length of the receptacle and is completely enveloped by the module body in a region of the receptacle.

2. The rotor shaft module of claim 1, wherein the insert element is arranged at least partially in the electrically insulating material of the module body.

3. The rotor shaft module of claim 2, wherein the rotor shaft module includes at least one opposing coupling apparatus, and wherein the at least one opposing coupling apparatus is formed by the insert element.

4. The rotor shaft module of claim 3, wherein the at least one coupling apparatus and the at least one opposing coupling apparatus are arranged at different axial ends of the rotor shaft module.

5. The rotor shaft module of claim 1, wherein the rotor shaft module includes at least one opposing coupling apparatus, and wherein the at least one opposing coupling apparatus is formed by the insert element.

6. The rotor shaft module of claim 5, wherein the at least one coupling apparatus and the at least one opposing coupling apparatus are arranged at different axial ends of the rotor shaft module.

7. The rotor shaft module of claim 1, wherein the insert element is arranged in the form of a frame around the receptacle.

8. The rotor shaft module of claim 1, wherein the insert element includes two or more coupling apparatuses and two or more opposing coupling apparatuses.

9. The rotor shaft module of claim 1, wherein the rotor shaft module includes at least one connecting apparatus for connection to an opposing connecting apparatus of a further rotor shaft module, and wherein the at least one connecting apparatus is formed by the module body.

10. The rotor shaft module of claim 1, wherein at least one of the electrically insulating material of the module body is a plastics material; and the insert element includes at least one of metal and a fiber composite material.

11. The rotor shaft module of claim 1, wherein the rotor shaft module is produced in a molding method, and wherein the electrically insulating material of the module body is formed around the insert element.

12. A rotor shaft for a molded-case circuit breaker comprising:

at least two coupled rotor shaft modules, the at least two rotor shaft modules each being designed as the rotor shaft module of claim 1.

13. A molded-case circuit breaker comprising:

the rotor shaft of claim 12.

14. A method for producing the rotor shaft module of claim 1 for a rotor shaft of a molded-case circuit breaker, comprising:

forming the electrically insulating first material of the module body around the insert element in a forming process.

15. The method of claim 14, wherein the forming process is an injection-molding process, and wherein the electrically insulating first material of the module body is injection-molded around the insert element.

16. The rotor shaft module of claim 1, wherein the rotor shaft module is produced in an injection molding method, and wherein the electrically insulating material of the module body is formed, by injection molding, around the insert element.

* * * * *